US005413018A

United States Patent [19]

Wada et al.

[11] Patent Number: 5,413,018

[45] Date of Patent: May 9, 1995

[54] PIEZO-ELECTRIC ACTUATOR OPERATED PRESS

[75] Inventors: Tatsuya Wada; Syouji Murayama; Kazuhiko Kuroda; Yukiyoshi Satomura; Tadashi Matsuoka; Mitsuharu Nonami; Kozo Matsumoto; Yukinori Kawamura; Norikatsu Matsumoto; Hiroshi Hikita; Hideo Iwata, all of Kanagawa, Japan

[73] Assignee: Fuji Electric Co., Ltd., Kanagawa, Japan

[21] Appl. No.: 220,464

[22] Filed: Mar. 31, 1994

Related U.S. Application Data

[63] Continuation of Ser. No. 896,584, Jun. 10, 1992, abandoned.

[30] Foreign Application Priority Data

Jun. 20, 1991 [JP] Japan ..... 3-147676
Oct. 25, 1991 [JP] Japan ..... 3-278127

[51] Int. Cl.[6] ..... B26F 1/02

[52] U.S. Cl. ..... 83/456; 83/466; 83/685; 83/701

[58] Field of Search ..... 83/142, 143, 380, 388, 83/389, 390, 554, 555, 567, 575, 577, 13, 344, 454, 685, 456, 466

[56] References Cited

U.S. PATENT DOCUMENTS

| | | | |
|---|---|---|---|
| 1,716,414 | 6/1929 | Beyer . | |
| 3,640,167 | 2/1972 | Axtmann | 83/380 |
| 3,700,150 | 10/1972 | Cheney | 83/13 |
| 3,739,669 | 6/1973 | Seki | 83/390 |
| 5,156,076 | 10/1992 | Rosemann | 83/344 |

FOREIGN PATENT DOCUMENTS

| | | | |
|---|---|---|---|
| 1517290 | 3/1967 | France . | |
| 1474209 | 1/1970 | Germany | 83/577 |
| 3321925A1 | 12/1983 | Germany . | |
| 2-127997 | 5/1990 | Japan . | |
| 3-90223 | 4/1991 | Japan . | |

OTHER PUBLICATIONS

Spanner et al., "Piezo-Translatoren" Elektronik, Mar. 26, 1982, pp. 91-94.

*Primary Examiner*—Kenneth E. Peterson
*Attorney, Agent, or Firm*—Finnegan, Henderson, Farabow, Garrett & Dunner

[57] ABSTRACT

A piezo-electric actuator operated press in which piezo-electric actuators are employed as punch driving sources, and, with a workpiece held between an upper and lower die set, the punches are driven by the piezo-electric actuators to punch the workpiece; the punches and the piezo-electric actuators are built in the respective die sets, and the movable one of the die sets is coupled to a die shifting mechanism, so that it is driven to a die opening position or a die closing position, whereby the workpiece can be smoothly fed in and taken out of the press.

9 Claims, 7 Drawing Sheets

PIEZO-ELECTRIC ACTUATOR OPERATED PRESS

This application is a continuation of application Ser. No. 07/896,584, filed Jun. 10, 1992, now abandoned.

BACKGROUND OF THE INVENTION

1. Field of the Invention

This invention relates to a punch press; and more particularly to one in which utilizes piezo-electric actuators as punch driving sources to punch a workpiece, such as a metal foil.

2. Discussion of the Related Art

A punching press for shearing a workpiece, such as a thin metal foil (several tens of micrometers) with high accuracy, namely, a press with lamination type piezo-electric actuators as punch driving sources is disclosed Japanese Patent Application (OPI) No. 127997/1990 (the term "OPI" as used herein means an "unexamined published application").

FIG. 10 shows the arrangement of the aforementioned press. As shown in FIG. 10, a frame 1 incorporates a variety of components such as a die unit comprising an upper die set 2, lower die set 3, movable stripper 4, upper die 5, lower die 6, upper punch 7 and lower punch 8, and piezo-electric actuators 9 for operating the stripper 4. Two actuator casings 12 are disposed on the top and bottom of the frame 1, respectively. The actuator casings 12 include piezo-electric actuators 10 provided as drive sources for the upper punch 7 and the lower punch 8 in combination with movable pieces 11, which are rod members for transmitting the amount of displacement of the respective piezo-electric actuators 10 to the punches. Further in FIG. 10, reference numeral 13 designates tightening screws for fixedly securing the die sets 2 and 3 inside the frame; springs 14 for urging the movable stripper 4; springs 15 for returning the punches 7 and 8; and pre-loaded springs 16 mounted on the movable pieces 11 so as to maintain pressure on the piezo-electric actuators at all times, the springs 16 being incorporated in the casings 12 together with the movable pieces 11.

In order to punch a belt-shaped workpiece or a metal foil 17, the press thus constructed operates as follows:

First, the piezo-electric actuators 9 are operated to move the movable stripper 4 upwardly. Under this condition, the workpiece 17 is fed into the space between the upper die 5 and the lower die 6. Thereafter, the piezo-electric actuators 9 are restored so that the workpiece 17 is held between the upper die 5 and the lower die 6 with the aid of the elastic forces of the urging springs 14. Under this condition, the upper punch 7 and the lower punch 8 are driven alternately with the piezo-electric actuators 10, to punch the workpiece 17 by so-called "vertical two-way punching". Thereafter, the piezo-electric actuators 9 are operated again to move the stripper 4 thereby to release the workpiece. The workpiece 17 thus released is shifted a predetermined distance.

The above-described press is impractical. As described above, in the press of FIG. 10, the piezo-electric actuators 10 are fixedly mounted on the top and the bottom of the frame 1, respectively, and the piezo-electric actuators 9 are driven to move the movable stripper 4 adapted to hold the workpiece 17. In general, the amount of displacement provided by a lamination type piezo-electric actuator, which is formed by stacking a number of piezo-electric elements, is no more than several tens of microns (μm). Therefore, when the movable stripper 4 is moved upwardly as was described above, the space formed between the upper and lower dies of the press is such that the metal foil workpiece 17 can be barely inserted into it; that is, the space is not quite large enough.

For example, if the workpiece is bent during pressing, or burrs are formed at the cut edges during shearing, the workpiece may be caught in the press. In such event, sometimes, it is at times impossible to feed the workpiece. If this occurs, no emergency measure can be taken; that is, it is impossible to release the workpiece, for instance, with a jig or tool inserted from outside, because the space between the upper and lower dies is considerably narrow, of the order of several tenths of microns. Therefore, the die unit must be disassembled to remove the workpiece caught in the press, which is a troublesome operation.

SUMMARY OF THE INVENTION

Accordingly, an object of this invention is to eliminate the above-described difficulties accompanying a conventional piezo-electric actuator operated press.

More specifically, an object of the invention is to provide a piezo-electric actuator operated press in which punch driving piezo-electric actuators and a die unit are improved in arrangement so that, when the die unit is opened, a sufficiently large space is formed between the top and bottom parts thereof, whereby the workpiece can be smoothly fed into and moved out of the press without interfering with the die unit, and even if the workpiece is caught in the press, it can be externally corrected with ease.

The foregoing object and other objects of the invention have been achieved in a first aspect by punches and punch driving piezo-electric actuators being built in die sets; and whereby one of the die sets, which is movable, is coupled to a die tightening or shifting mechanism, so that it is moved to a die opening position or a die closing position.

The first aspect is preferably embodied technically as follows:

A piezo-electric actuator together with a movable piece and a pre-loaded spring for transmitting the displacement of the piezo-electric actuator to the punch is accommodated in an actuator casing in such a manner that it is subjected to pressure. The actuator casing is built in the die set. A position adjusting mechanism is provided for the piezo-electric actuator, in such a manner that it is positioned between the actuator casing accommodating the piezo-electric actuator and the die set, to set the initial position of the punch.

The position adjusting mechanism comprises: a wedge mechanism inserted between the rear surface of the piezo-electric actuator and the die set; and pressure means for pushing the casing against the wedge mechanism. The wedge mechanism comprises: a wedge piece inserted between the rear surface of the actuator casing and the die set; and an adjusting bolt for moving the wedge piece back and forth, and one end portion of the wedge piece is loosely engaged with the shank of the adjusting bolt.

The pressure means includes a compression spring interposed between the front surface of the casing and the die set, or it includes: a rod built in the actuator casing in such a manner that the end portion of the rod protrudes from the front surface of the actuator casing;

and a compression spring for urging the rod towards the die set.

The punch driven by the piezo-electric actuator may be contouring punch with a piercing punch built in the contouring punch, so that a workpiece is contour-punched and pierce-punched at the same time. A spring seat is formed in the outer wall of the rear end portion of the contouring punch, and return springs are connected between the spring seat and the die set, to urge the punch rearwardly.

In a second aspect, an upper die set and a lower die set are set between a stationary die plate and a movable die plate coupled to a mechanical die shifting mechanism, and punch driving piezo-electric actuators are mounted on the die plates in such a manner as to oppose the punches built in respective die sets.

The technical concept of the second problem solving means described above can be embodied as follows:

A plurality of punches are built in each of the die sets, a movable plate is interposed between the die set and the piezo-electric actuator in such a manner as to cover the plurality of punches, and those punches are driven simultaneously through the movable plate by the piezo-electric actuator. The movable plates are built in the die plates or die sets in such a manner that the movable plates are supported in a respective guide mode.

A plurality of piezo-electric actuators are provided on each die plate in such a manner as to oppose the corresponding movable plate, and the plurality of piezo-electric actuators thus provided are synchronously energized to drive the movable plate.

Basically, according to the first and second aspects of the invention, the movable one of the upper and lower dies which are arranged on both sides of the workpiece conveying path is coupled to the mechanical die shifting mechanism made up of an air cylinder or hydraulic cylinder so that it is moved to the die opening position or the die closing position. The punch driving piezo-electric actuators are built in the die sets in combination with the punches, respectively, or mounted on the die plates to which the die sets including the punches are connected. Therefore, each of the piezo-electric actuators is moved to the die opening position or the die closing position in association with the die set. Hence, it is unnecessary to adjust the die opening and closing stroke of the die tightening mechanism to the stroke of displacement of the punch. The mechanical die shifting mechanism provides much larger die opening and closing strokes than the piezo-electric actuator. Therefore, the workpiece can be fed in and taken out of the press without interference with the die unit. Even if the workpiece is caught inside the press during punching, emergency measures can be taken; that is, it may be corrected inside the press or removed from it with a suitable jig, because the die can be opened wide enough by operating the die shifting mechanism.

Furthermore, in the various embodiments described herein, the punches can be positioned in place with ease. In addition, a plurality of piercing punches and contouring punches are built in the die. Therefore, when it is necessary to punch a workpiece with a contouring punch and a piercing punch, those punching operations can be carried out simultaneously or successively on only one press.

The nature, utility and principle of the invention will be more clearly understood from the following detailed description and the appended claims when read in conjunction with the accompanying drawings.

DETAILED DESCRIPTION OF THE INVENTION

Figure 1:
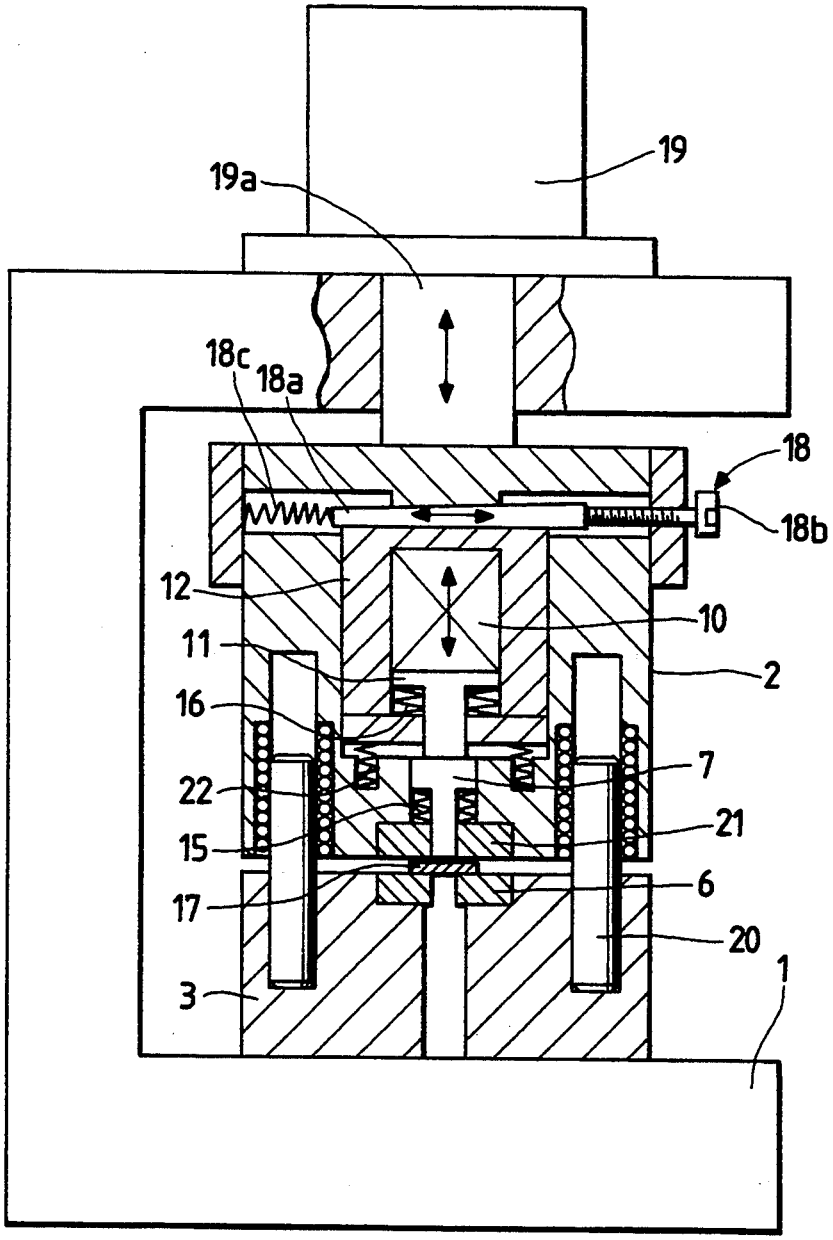
FIG. 1 is a sectional view showing a vertical press with a one-way punching system according to a first embodiment of the present invention.

Preferred embodiments of this invention will be described with reference to the accompanying drawings, in which parts corresponding functionally to those which have been described with reference to FIG. 10 (the prior art) are therefore designated by the same reference numerals or characters.

An example of a vertical press with a one-way punching system wherein punches and punch driving piezo-electric actuators or built in the sets, and one of the die sets, which is movable, is coupled to a die tightening or shifting mechanism so that it is moved to a die opening or die closing position according to a first embodiment of the invention, will be described with reference to FIG. 1.

In the first embodiment, upper die set 2 forms an assembly with punch 7, piezo-electric actuator 10 for driving the punch 7, and a position adjusting mechanism 18 (hereinafter described) provided for piezo-electric actuator 10. This assembly is coupled to a ram 19*a* of a die shifting mechanism 19 mounted on the top of frame 1. The mechanism 19 comprises an air cylinder or hydraulic cylinder. The lower die set 3, opposing upper die set 2, is fixedly mounted on frame 1. The die set 3 also includes die 6 which is used in combination with the punch 7. The press further comprises guide pins 20 in engagement with the upper die set 2, and a punch guide 21.

The piezo-electric actuator 10, the movable piece 11 and the pre-loaded spring 16 are accommodated in the actuator casing 12, which is set inside the die set 2 in such a manner that the piezo-electric actuator 10 is vertically slidable. The aforementioned position adjusting mechanism 18 is provided above the casing 12 accommodating the piezo-electric actuator 10, and a compression spring 22 for urging the casing 12 towards the position adjusting mechanism 18 is provided below the piezo-electric actuator 10. The position adjusting mechanism is a kind of wedge mechanism which comprises: a wedge piece 18*a* inserted into the rear surface of the casing 12 accommodating the piezo-electric actuator 10 a wedge or tapered groove formed in the die set 2; and an adjusting bolt 18*b* and a compression spring 18*c* arranged on both sides of the wedge piece 18*a*. The position adjusting mechanism 18 is a fine adjusting means for initially positioning the punch 7 in place before the start of the press. That is, when the wedge piece 18*a* is moved to the left-hand side as viewed in FIG. 1, by turning the adjusting bolt 18*b* clockwise, the piezo-electric actuator 10 is moved downwardly against the compression spring 22; and when the adjusting bolt 18*b* is turned counterclockwise, the wedge piece 18*a* is moved to the right-hand side, as viewed in the drawing so that the piezo-electric actuator 10 is moved upwardly being urged by the compression spring 22. Thus, the initial position of the punch 7 can be set correctly with the variations in dimension of the related components compensated. Instead of the above-described position adjusting mechanism 18, an adjusting screw may be employed which is screwed into the die set 2 from above to abut against the end face of the casing 12 accommodating the piezo-electric actuator 10. However, the adjusting screw tends to interfere with the frame 1 when operated. On the other hand, with the above-described wedge mechanism, the position adjustment of the punch can be freely achieved without interfering with the frame 1.

The operation of the press thus constructed will be described with reference to the situation where a workpiece 17 is punched on it.

First, the die shifting mechanism 19 is operated to move the upper die set 2 upwardly. Under this condition, the die unit is opened to provide a sufficiently wide space between the upper die set 2 and the lower die set 3. Thereafter, the workpiece 17 is fed to the work position, and then the die shifting mechanism 19 is operated to move the die set 2 downwardly to a closed position, so as to hold the workpiece 17 between the die 6 and the die set 2. Under this condition, voltage is applied to the piezo-electric actuator 10 to move the punch 7 downwardly, as a result of which the workpiece 17 is punched. Thereafter, the application of voltage to the piezo-electric actuator 10 is suspended, while the die tightening mechanism is operated to open the die unit to release the workpiece 17. The workpiece 17 thus released is shifted a predetermined distance. Thereafter, the above-described operations are repeatedly carried out, to continuously punch the workpiece 17.

Figure 2:
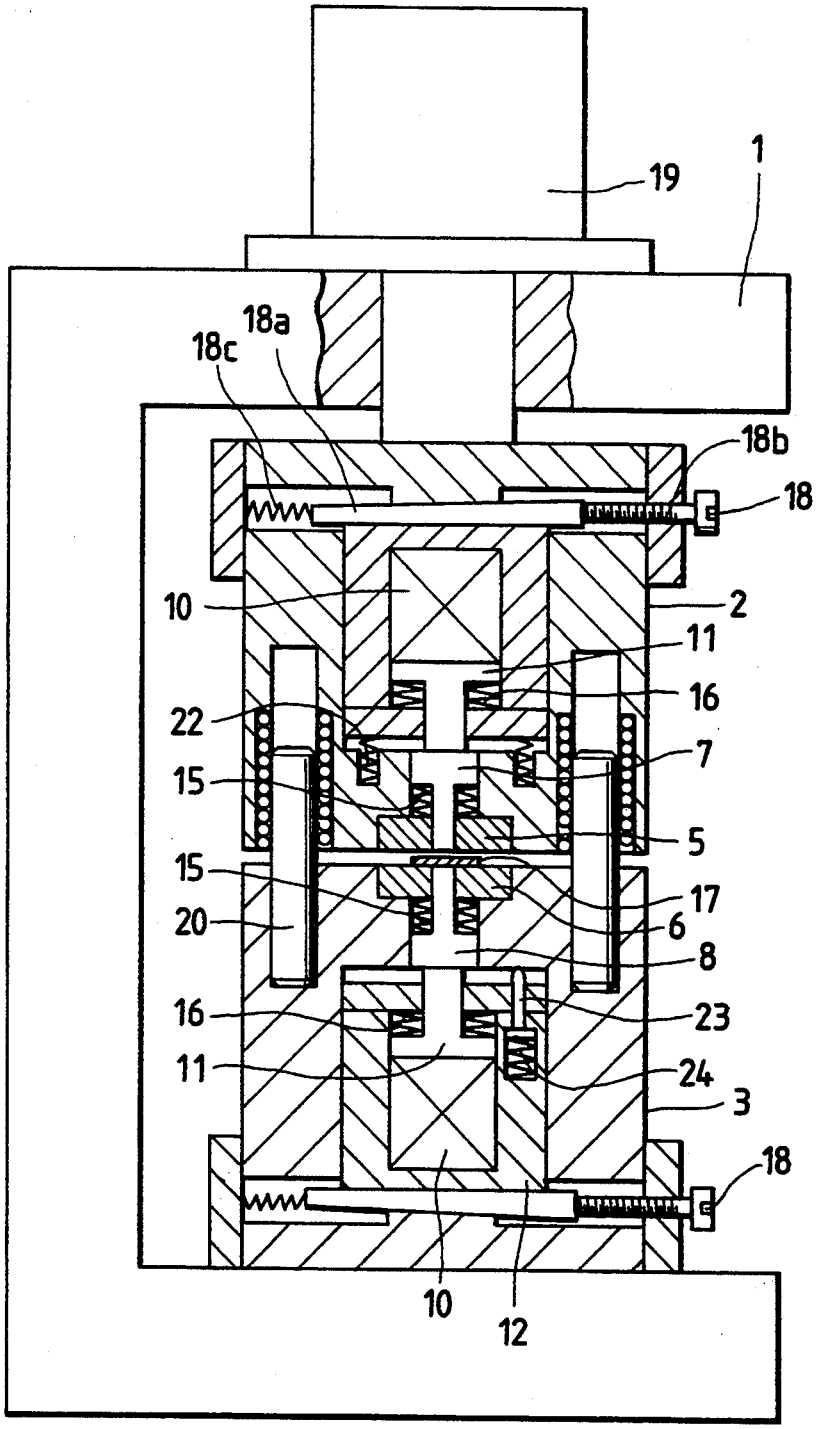
FIG. 2 is a sectional view showing a vertical press with a two-way punching system according to a second embodiment of the present invention.

FIG. 2 shows the arrangement of one example of a vertical press with a two-way punching system which constitutes a second embodiment of the present invention.

Figure 10:
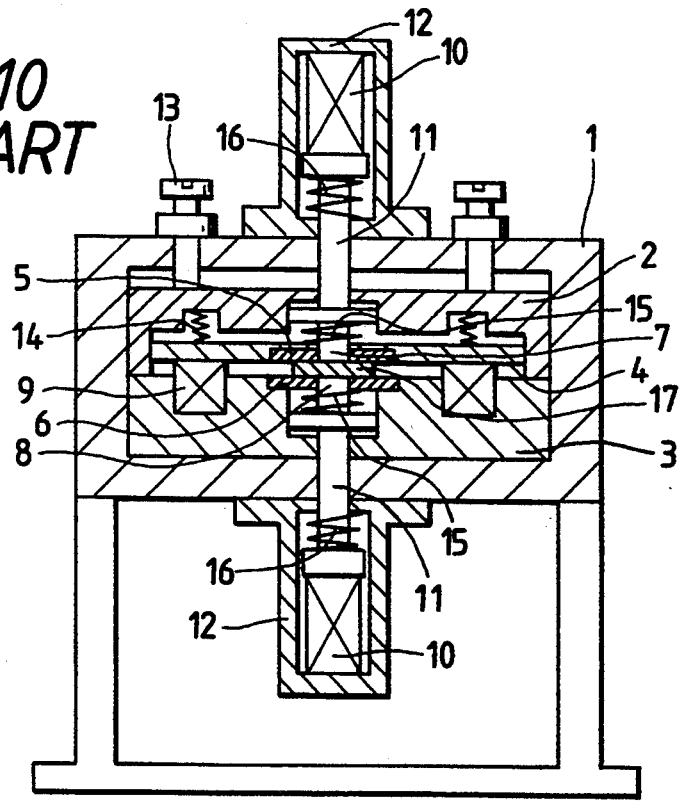
FIG. 10 PRIOR ART
FIG. 10 is a sectional view of a conventional piezo-electric actuator operated press.

Similar to the press shown in FIG. 10, the upper die set 2 incorporates the punch 7 and the piezo-electric actuator 10, while the lower dies set 3 incorporates the punch 8 and the piezo-electric actuator 10. The die set 2 is coupled to a die shifting mechanism 19 similarly as in the press shown in FIG. 1 (the first embodiment). Furthermore, similar to the first embodiment described above, each of the die sets 2 and 3 has the position adjusting mechanism 18 on one side of the casing 12, and pressure means for pushing the casing 12 towards the position adjusting mechanism 18 on the other side of the casing 12. The pressure means in the upper die set 2 is a compression spring 16 which is similar to the one in the first embodiment (FIG. 1). The pressure means in the lower die set 3 is designed as follows: The pressure means comprises a rod 23 whose end portion protrudes through a hole formed in a front wall of the casing 12; and a compression spring 24 urges the rod 23 from behind. The pressure means is built in the casing 12 in such a manner that the compression spring pushes the rod 23 against the die set 3 so that the reaction of it pushes the casing 12 against the position adjusting mechanism 18.

Figure 3:
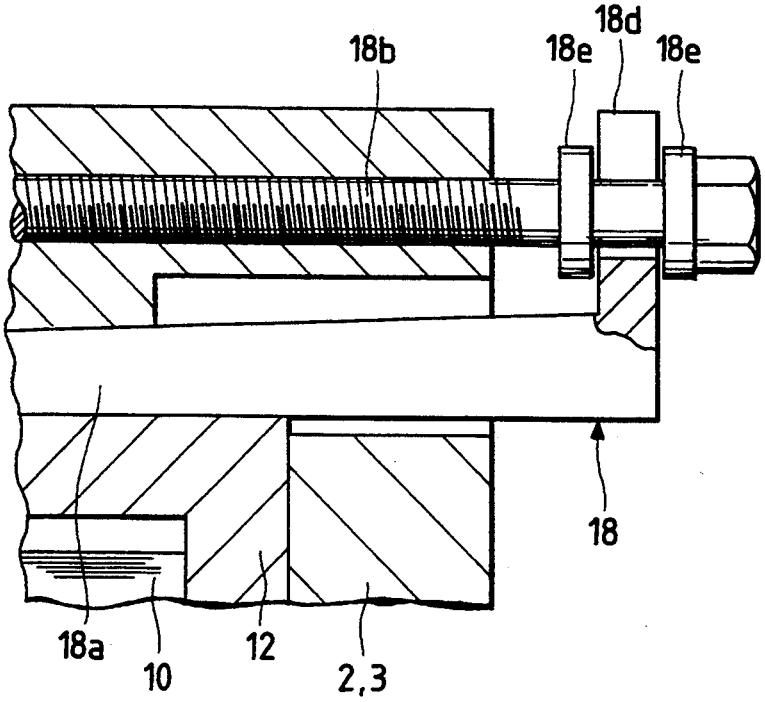
FIG. 3 is an enlarged fragmentary view.
Figure 4:
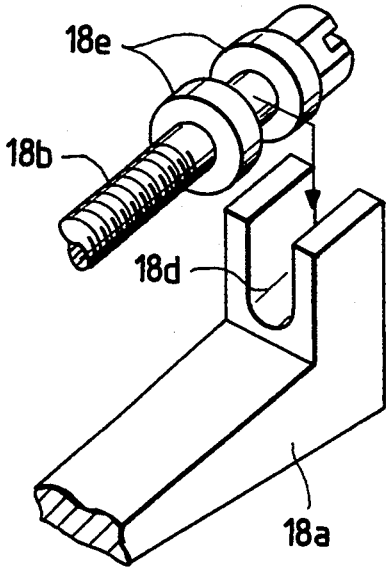
FIG. 4 is a fragmentary view in perspective showing essential components of one modification of a position adjusting mechanism for a piezo-electric actuator in each of the presses shown in FIGS. 1 and 2, respectively.

FIGS. 3 and 4 shows one modification of the wedge mechanism, or the position adjusting mechanism 18, for the piezo-electric actuator 10 in the above-described first or second embodiment. One end portion of the wedge piece 18 is bent like the character "L", and a U-shaped grove 18*d* is formed in the end portion thus bent. On the other hand, a pair of flanges 18*e* are formed on the adjusting bolt 18 near the head. The adjusting bolt 18*b* is loosely engaged with the U-shaped groove 18*d* with the pair of flanges 18*e* set on both sides of the end portion where the U-shaped groove 18*d* is formed. With the position adjusting mechanism thus designed, the wedge piece 18*a* is moved back and forth as the adjusting bolt 18*b* is turned. Therefore, the modification dispenses with the compression spring 18*c* employed in the above-described first and second embodiment, and can adjust the position more positively.

Figure 5:
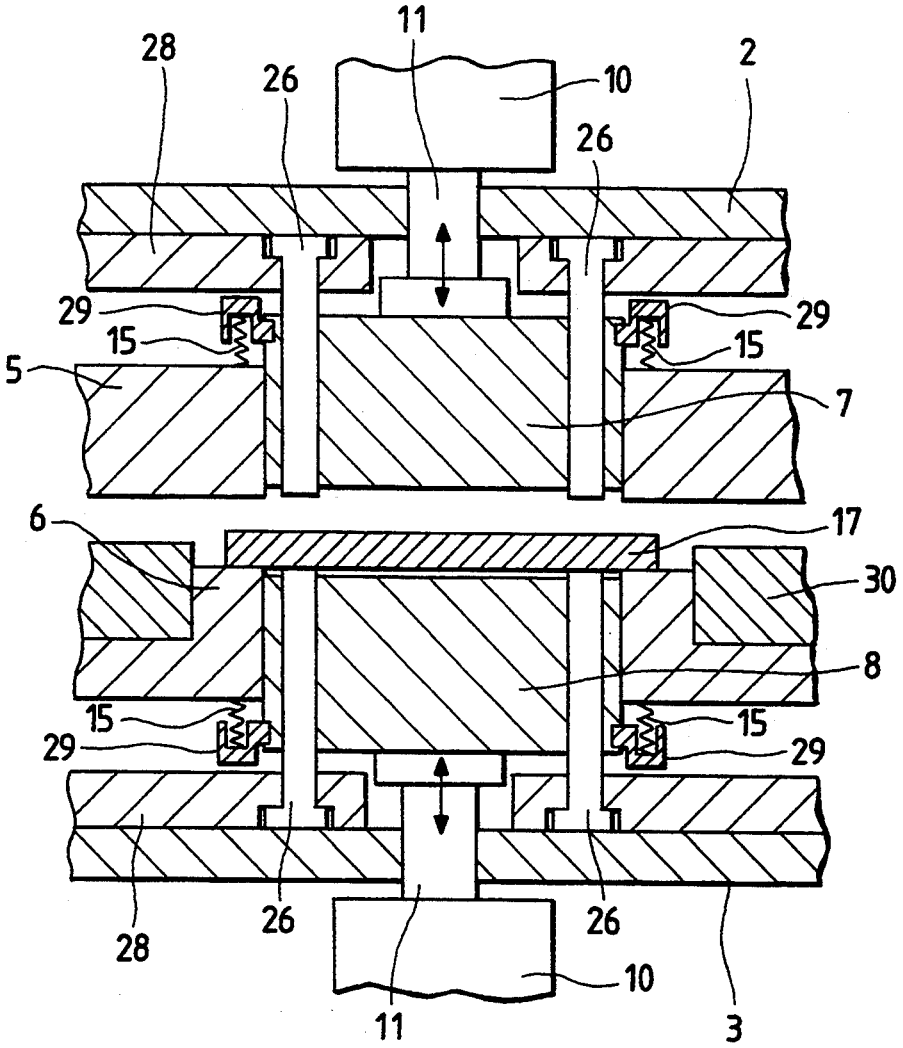
FIG. 5 is an enlarged fragmentary section view showing a die unit in a press in which workpiece contouring and piercing operations are carried out simultaneously, in accordance with a third embodiment of the present invention.
Figure 6:
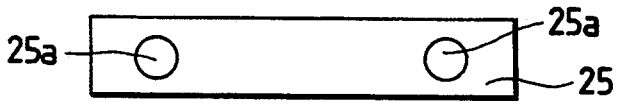
FIG. 6 is a plan view of an article formed on the press shown in FIG. 5.

FIG. 5 shows one example of a press for forming an article 25 which, as shown in FIG. 6, is in the form of an elongated rectangle with two holes, which constitutes a third embodiment of the invention. In the third embodiment, the upper die set 2 and the lower die set 3 have contouring punches 7 and 8 corresponding to the contour of the article 25, and piercing stationary punches 26 and 27 built in the punches 7 and 8 to form the holes 25*a* in the article 25, respectively. The contouring punches 7 and 8 are fitted in the dies 5 and 6, respectively. The contouring punches 7 and 8 thus fitted are driven by the corresponding movable piece 11 which in turn is drawn by the piezo-electric actuator 10, similar to the above-described first and second embodiments. The piercing stationary punches 26 and 27 are fixedly secured through respective punch holders 28 to the die sets 2 and 3. In order to push the punches 7 and 8 against the movable pieces 11 for moving the latter in a reciprocation mode, returning springs 15 are employed. More specifically, grooves are formed in the outer walls of the rear end portions of the punches 7 and 8, respectively, and spring seats 29 are fitted in the corresponding grooves. The return springs 15 are each inserted between one of the spring seats 29 and the corresponding die 5 and 6. With this structure, the returning springs 15 will never interfere with the stationary punches. This structure can be employed even when the contouring punches 7 and 8 are intricate in configuration.

The press thus designed operates as follows: When the die unit is closed with the workpiece 17 fed therein, the workpiece 17 is held between the upper and lower dies 5 and 6 and accordingly between the piercing punches 26 and 27, while the piercing punches 26 and 27 go in the workpiece 17 to form the holes 25*a*. Thereafter, with the die unit held closed, the contouring punches 7 and 8 are moved towards and retracted from the workpiece alternately by the respective piezo-electric actuators 10. That is, the workpiece is contour-punched by "vertical two-way punching", so that the article 25 as shown in FIG. 6 is formed.

The piercing punches 26 and 27 are so set that their ends are flush with the end faces of the dies 5 and 6, respectively. In the case where the piercing punches are thin, they may be broken when the workpiece is held between the upper and lower dies. That is, when the die unit is closed to hold the workpiece, an excessively large load may be applied to the piercing punches to break the latter. In order to eliminate this difficulty, a liner 30 corresponding in thickness to a workpiece 17 to be handled is provided for the lower die 6 as shown in FIG. 5. When the die unit is closed, the upper surface of the liner 30 serves as a stopper, to prevent the application of an excessively large load to the piercing punches 26 and 27.

In the previously described first embodiment, the punching operation is carried out according to the vertical one-way punching system; and in the second and third embodiments, the punching operation is carried out according to the vertical two-way punching system. The second or third embodiment, which has the punches in the upper and lower parts of the die unit, may employ a punching method in which the workpiece is held between the upper punch and the lower punch; and then the piezo-electric actuators are driven to vibrate those punches repeatedly. The present inventors have confirmed that, according to the punching method, even a metal foil of thin stainless steel, such as several tens of micrometers thin (μm), for example, can be accurately punched without formation of burrs.

Figure 7:
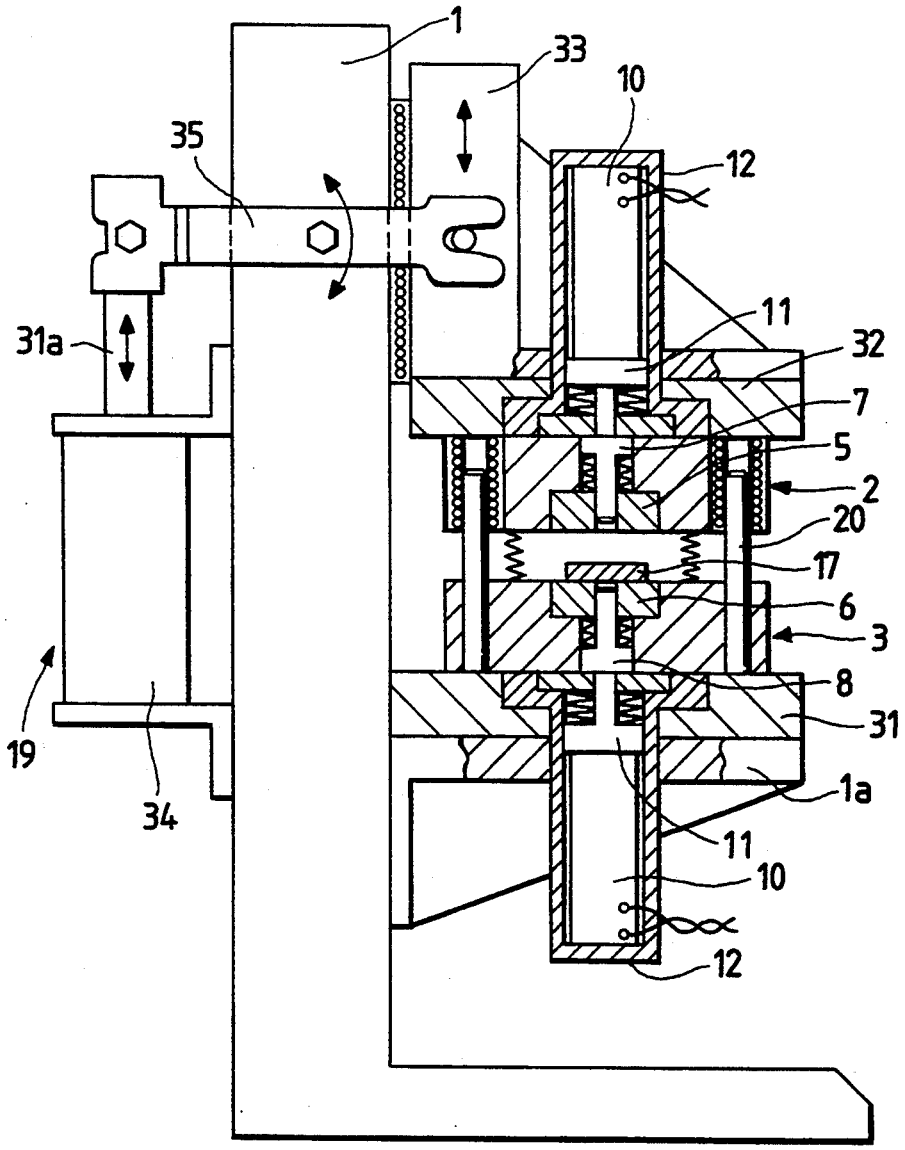
FIG. 7 is an elevational view partly in section showing a vertical press with a two-way punching system according to a fourth embodiment of the present invention.

A fourth embodiment of a two-way punching system press according to the second aspect of the invention wherein an upper die set and a lower die set are set between a stationary die plate and a movable die plate coupled to a mechanical die shifting mechanism, and punch driving piezo-electric actuators are mounted on the die plates in such a manner as to oppose the punches built in respective die sets will be described with reference to FIG. 7. The press, as shown in FIG. 7, is constructed as follows: The punches 7 and 8 are built in the upper and lower parts of the die unit, respectively. The lower die set 3 is mounted through a stationary die or fixing plate 31 on a table 1 mounted to frame 1. A sliding member 33 is coupled to a mechanical die shifting mechanism 19, which is made up of a hydraulic cylinder 34, a cylinder rod 34*a*, and a swing lever 35 pivotably connected between the cylinder rod and the slider 33. The slider 33 is moved vertically along the frame 1 by the hydraulic cylinder 34, so that the upper part of the die unit, being guided by guide posts 20, is moved away from and towards the lower part of the die unit; that is, it is moved to a die opening position or a die closing position. The piezo-electric actuators 10, which are adapted to drive the corresponding punches 7 and 8 are built in the actuator casings 12 and are similar in structure to those of the first embodiment. These actuators 10 are fitted in the stationary and movable die plates 31 and 32, respectively, in such a manner that the end faces of the movable pieces 11 are confronted with the rear end faces of the punches 7 and 8, respectively.

The operation of the press of FIG. 7 will be described in connection with the punching of a workpiece 17. First, the die shifting mechanism 19 is operated to open the die unit. With the die unit opened, the workpiece 17 is fed into the space between the upper die set 2 and the lower die set 3; and then the die shifting mechanism 19 is operated to close the die unit; that is, the workpiece 17 is fixedly held between the upper and lower parts of the die unit. Under this condition, voltage is applied to the piezo-electric actuators alternately which are coupled to the stationary die plate 31 and the movable die plate 32, to punch the workpiece 17 by two-way punching. After the workpiece 17 has been punched in this way, the die tightening mechanism 19 is operated to open the die unit to release the workpiece 17. The workpiece thus released is then moved to a subsequent processing station.

In the fourth embodiment, similar to the above-described first through third embodiments, the workpiece can be smoothly fed into the press. Furthermore, in the fourth embodiment, the piezo-electric actuators 10 are separated from the die sets 2 and 3, and instead they are coupled to the die plates 31 and 32. This arrangement is beneficial in that the die can be replaced with ease. In addition, the piezo-electric actuators can be readily removed; and therefore, when it is necessary to inspect or replace the piezo-electric actuators, it is unnecessary to disassemble the die unit.

Figure 8:
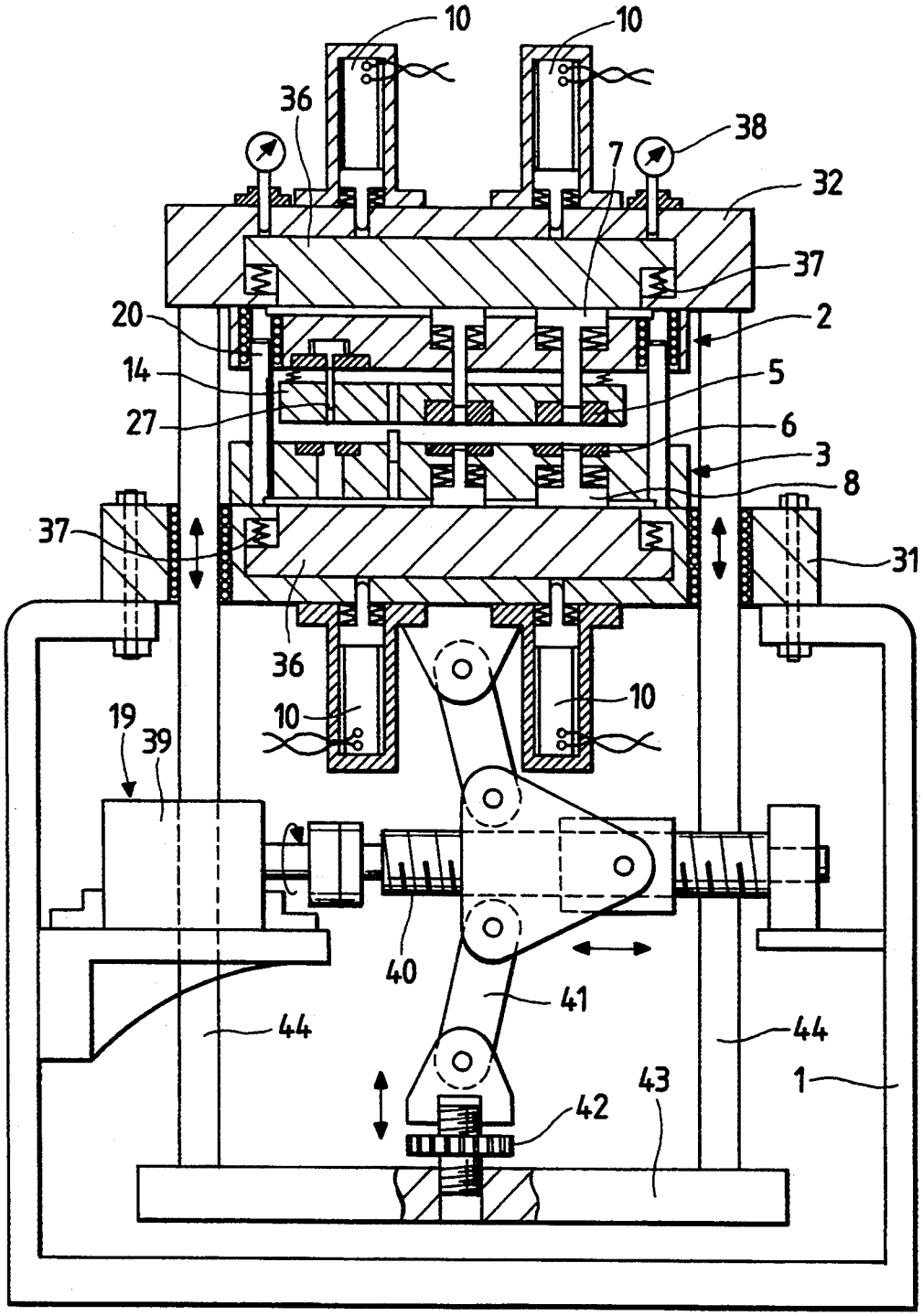
FIG. 8 is an elevational view partly in section of a vertical press with a two-way punching system according to a fifth embodiment of the invention.

FIG. 8 shows a fifth embodiment of a press with a two-way punching system, in which a plurality of punches are built in the die; and the workpiece is moved successively in the die unit. The fifth embodiment is different from the fourth embodiment as follows: A plurality of punches 7 and a plurality of dies 5 are built in the upper die set 2. Similarly, a plurality of punches 8 and a plurality of dies 6 are built in the lower die set 3. A movable plate 36 is interposed between the piezo-electric actuators 10 coupled to the stationary die plate 31 and the punches 8 in such manner that it covers the punches 8. Similarly, another movable plate 36 is interposed between the piezo-electric actuators 10 coupled to the movable die plate 31 and the punches 7 in such a manner that it covers the punches 7. The movable die plates 36 are built in the stationary and movable die plates 31 and 32, respectively, in such a manner that they are vertically movable.

The piezo-electric actuators are mounted on the die plates 31 and 33 in such a manner that two piezo-electric actuator 10 are provided on the rear side of each of the movable plates 36 at predetermined intervals. The movable plates 36 are urged towards the piezo-electric actuators 10 by springs 37. The displacement of the movable plate 36 is monitored by a displacement gauge 38. A movable stripper 14 is provided between the upper die set 2 and the lower die set 3.

In the fifth embodiment, the die tightening mechanism 19 is of so-called "toggle type". The output shaft of a driving servo motor 39 is connected to a feed screw mechanism 40 which is coupled to a toggle link mechanism 41. A coupling bar 43 is connected through an adjusting screw 42 to the link mechanism 41 at the bottom dead point. The coupling bar 43 thus connected is coupled through slide shafts 44 to the above-described movable die plate 32.

In the fifth embodiment, the workpiece pressing operation is fundamentally similar to those in the above-described first through fourth embodiments. The piezo-electric actuators 10, two for each of the stationary and movable die plates 31 and 32, are synchronously energized, so that the plurality of punches built in the upper and lower die sets 2 and 3 are driven through the movable plates 36 simultaneously. Thus, by moving the workpiece in the press successively, one article can be formed with a plurality of punches. In the fifth embodiment, two piezo-electric actuators 10 are provided for each movable plate 36 as was described above; and therefore, the movable plate 36 can be moved uniformly. In this embodiment, in addition to the punches 7 and 8 being driven by the piezo-electric actuators 10, a stationary punch 27 may also be provided.

Figure 9:
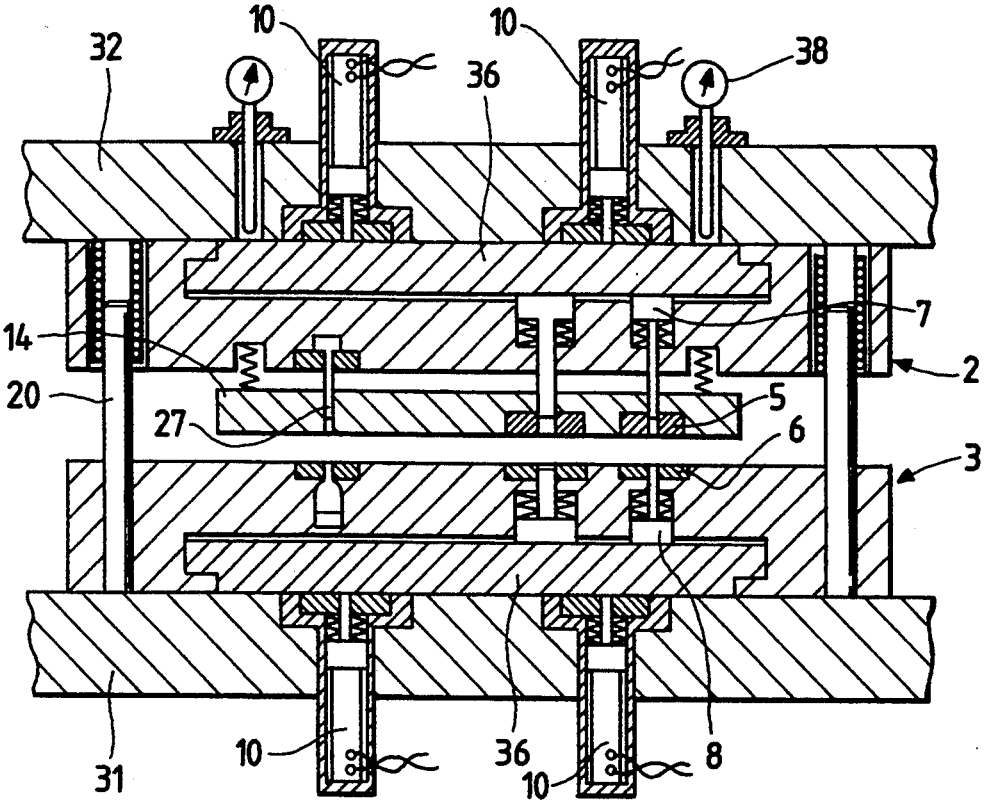
FIG. 9 is an enlarged fragmentary sectional view of a vertical press with a two-way punching system according to a sixth embodiment of the present invention.

FIG. 9 shows a sixth embodiment which is a modification of the fifth embodiment. In the previously described embodiment of FIG. 8, the movable plates 36 are built in the die plates 31 and 32, that is, each die plate is partially changed in wall thickness, which decreases the mechanical strength. In order to overcome this difficulty, in the fifth embodiment the movable plates 36 are built in the die sets 2 and 3 instead of the die plates 31 and 32 respectively.

As was described above, in the piezo-electric actuator operated press according to the invention, the punch driving actuators are built in the die set together with the punches, or mounted on the die plates coupled to the die sets; and the movable die set is coupled to the mechanical die shifting mechanism so that it is moved to the die opening position or the die closing position together with the piezo-electric actuator or actuators. Hence, in the press of the invention, the die unit can be opened wide enough with the die shifting mechanism. Thus, the workpiece can be fed into and taken out of the press without interference with the die unit. Even if the workpiece is caught in the press during the punching operation, emergency measures can be taken; that is, it may be corrected inside the press or removed from it with a suitable jig. That is, the press according to the invention can be handled with ease.

While there has been described preferred embodiments of this invention, it will be obvious to those skilled in the art that various changes and modifications may be made therein without departing from the invention, and it is intended, therefore, to cover in the appended claims all such changes and modifications as fall within the true spirit and scope of the invention.

We claim:

1. A piezoelectric actuator operated press for punching a metallic foil workpiece, comprising:

a frame;

a die shifting mechanism mounted to the frame;

a first die set having a face mounted to the frame;

a second die set mounted to the die shifting mechanism, said second die set having a face opposing the face of said first die set, said second die set being movable selectively by the die shifting mechanism toward the face of the first die set to a specific closed position to hold the workpiece; and movable away from said face to a specific open position, wherein the second die set is spaced a greater distance from the face of the first die set than when in the closed position to permit the work piece to be inserted between the faces of the first and second die sets;

a casing mounted to and movable with said one of the first and second die sets and a spring disposed in the casing urging the actuator in a direction away from the face of the other of the first and second die sets;

a punch movably mounted to at least one of said first and second die sets, the punch having an end opposing said face of another of the first and second die sets;

position adjusting means including a member having a wedge configuration movable in a direction substantially different from the movement of the punch, said member being disposed between opposing surfaces of said casing and said one die set for positioning the punch in said one die set, and means pressing said casing against said wedge member; and a piezoelectric actuator mounted to said at least one of said first and second die sets disposed to drive said punch to punch a workpiece disposed between the opposing faces of the first and second die sets at times when the second die set is in the closed position.

2. The press of claim 1 wherein the punch and the actuator is mounted to the second die set.

3. The press of claim 1 further comprising a second punch movably mounted in the other of the first and second die sets, the punch having an end opposing the face of the one of the first and second die sets; and a second piezoelectric actuator mounted in the other of said first and second die sets disposed to drive said second punch to punch a workpiece disposed between the opposing faces of the first and second die sets at times when the first and second die sets are in a closed position.

4. The press of claim 3 wherein the piezoelectric actuator and the second piezoelectric actuator each includes a casing mounted to and movable with a respective first and second die set, and a spring disposed in each casing urging each actuator in a direction toward the opposing face of the respective first and second die sets.

5. The press of claim 1 wherein the position adjusting means further comprises an adjusting bolt engaging the wedge for moving said wedge back and forth to move the casing in the direction of the punch.

6. The press of claim 5, wherein said position adjusting means includes a spring urging the wedge in engagement with a shank of the adjusting bolt.

7. The press of claim 1, wherein the pressing means includes a compression spring interposed between an opposing surface of said casing and said die set.

8. The press of claim 1, wherein said pressing means comprises:

a rod disposed in said actuator casing, said rod having an end portion protruding from a surface of said actuator casing opposing the second die set; and a compression spring for urging said rod towards said second die set.

9. The press of claim 1 further comprising a rod disposed in said actuator casing, said rod having an end portion protruding from a surface of the actuator casing opposing said one of the first and second die set, and a compression spring for using the rod in a direction toward the casing and said one of the first and second die sets.

* * * * *

UNITED STATES PATENT AND TRADEMARK OFFICE

CERTIFICATE OF CORRECTION

PATENT NO. : 5,413,018

DATED : May 09, 1995

INVENTOR(S) : Tatsuya WADA et al

It is certified that error appears in the above-indentified patent and that said Letters Patent is hereby corrected as shown below:

CLAIM 2, COLUMN 10, LINE 22, "is" should read --are--.

Signed and Sealed this

Twenty-fifth Day of June, 1996

Bruce Lehman

*Attest:*

BRUCE LEHMAN

*Attesting Officer*

*Commissioner of Patents and Trademarks*